US006856189B2

(12) United States Patent
Somerville

(10) Patent No.: US 6,856,189 B2
(45) Date of Patent: Feb. 15, 2005

(54) DELTA VGS CURVATURE CORRECTION FOR BANDGAP REFERENCE VOLTAGE GENERATION

(75) Inventor: Thomas A. Somerville, Tempe, AZ (US)

(73) Assignee: Standard Microsystems Corporation, Hauppauge, NY (US)

( * ) Notice: Subject to any disclaimer, the term of this patent is extended or adjusted under 35 U.S.C. 154(b) by 0 days.

(21) Appl. No.: 10/447,569

(22) Filed: May 29, 2003

(65) Prior Publication Data

US 2004/0239411 A1 Dec. 2, 2004

(51) Int. Cl.[7] ..... G05F 1/10
(52) U.S. Cl. ..... 327/539
(58) Field of Search ..... 327/378, 512, 327/513, 530, 534, 535, 537, 539

(56) References Cited

U.S. PATENT DOCUMENTS

| | | | | |
|---|---|---|---|---|
| 4,250,445 | A | 2/1981 | Brokaw | |
| 4,603,291 | A | 7/1986 | Nelson | |
| 4,939,442 | A | 7/1990 | Carvajal et al. | |
| 5,291,122 | A | 3/1994 | Audy | |
| 5,325,045 | A | 6/1994 | Sundby | |
| 5,352,973 | A | 10/1994 | Audy | |
| 5,391,980 | A | 2/1995 | Thiel et al. | |
| 5,767,664 | A | 6/1998 | Price | |
| 6,218,822 | B1 | 4/2001 | MacQuigg | |
| 6,232,828 | B1 | 5/2001 | Smith et al. | |
| 6,362,612 | B1 * | 3/2002 | Harris | 323/312 |
| 6,489,835 | B1 * | 12/2002 | Yu et al. | 327/539 |
| 6,501,299 | B2 * | 12/2002 | Kim et al. | 326/83 |
| 6,529,066 | B1 * | 3/2003 | Guenot et al. | 327/539 |
| 6,724,176 | B1 * | 4/2004 | Wong et al. | 323/316 |
| 2002/0036326 | A1 | 3/2002 | DeJong et al. | |
| 2002/0158680 | A1 | 10/2002 | Pertus et al. | |

OTHER PUBLICATIONS

O. Salminen, K. Halonen, "The Higher Order Temperature Compensation of Bandgap Voltage References," Proceedings of 1992 IEEE International Symposium on Circuits and Systems, vol. 3, pp. 1388–1391, May 10–13, 1992.

P. Malcovati, F. Maloberti, C. Fiocchi, M. Pruzzi, "Curvature–Compensated BiCMOS Bandgap with 1–V Supply Voltage," IEEE JSSC, vol. 36, pp. 1076–1081, Jul. 2001.

* cited by examiner

*Primary Examiner*—Jeffrey Zweizig
(74) *Attorney, Agent, or Firm*—Meyertons Hood Kivlin Kowert & Goetzel, P.C.; Jeffrey C. Hood

(57) ABSTRACT

A bandgap voltage reference generator may include a BJT (Bipolar Junction Transistor) and a pair of MOSFETs (Metal Oxide Semiconductor Field Effect Transistors) coupled to the BJT. The base-emitter voltage Vbe of the BJT may exhibit a non-linearity with respect to temperature. The difference between gate-source voltages of the pair of MOSFETs exhibits an opposite non-linearity with respect to temperature. The opposite non-linearity reduces the effect of the non-linearity on the output voltage of the bandgap voltage reference generator. The difference in gate-source voltages of the pair of MOSFETs may be determined by the ratio of channel width to channel length of each MOSFET included in the pair of MOSFETs.

15 Claims, 2 Drawing Sheets

DELTA VGS CURVATURE CORRECTION FOR BANDGAP REFERENCE VOLTAGE GENERATION

BACKGROUND

1. Field of the Invention

This invention relates generally to the field of analog integrated circuit design and, more particularly, to voltage reference design.

2. Description of the Related Art

Many different devices and technologies require temperature-stable reference voltages. A common circuit used to provide such a reference voltage is a bandgap voltage reference circuit. Bandgap voltage reference circuits typically operate by summing a base-emitter voltage (Vbe) of a bipolar junction transistor BJT), which has a negative temperature drift, with a thermal voltage Vt that has a positive temperature drift. The thermal voltage Vt is typically dependent on the difference between Vbe of two BJTs operating at different emitter current densities. The value of the resulting bandgap voltage Vbg (Vref) is the sum of Vbe of one BJT and a quantity proportional to the difference in Vbe between two BJTs.

Typically, the output of a bandgap voltage reference circuit has a non-zero temperature coefficient (TC) for values of temperature other than a nominal operating temperature. In some applications, errors in the output voltage that arise due to this non-zero temperature coefficient may be unacceptable. Furthermore, correction circuitry may be expensive or overly complicated. The performance of the correction circuitry itself may also be subject to errors that arise due to process variations. Accordingly, new correction techniques for bandgap voltage reference circuits are desired.

SUMMARY

Various embodiments of systems for providing delta Vgs curvature correction in a bandgap voltage reference are disclosed. A bandgap voltage reference generator may include a BJT (Bipolar Junction Transistor) and a pair of MOSFETs (Metal Oxide Semiconductor Field Effect Transistors) coupled to the BJT. The base-emitter voltage Vbe of the BJT may exhibit a non-linearity with respect to temperature. The difference between gate-source voltages of the pair of MOSFETs exhibits an opposite non-linearity with respect to temperature. The opposite non-linearity reduces the effect of the non-linearity on the output voltage of the bandgap voltage reference generator. The difference in gate-source voltages of the pair of MOSFETs may be determined by the ratio of channel width to channel length of each MOSFET included in the pair of MOSFETs.

In some embodiments, such a bandgap voltage reference generator may include an additional BJT and an additional pair of MOSFETs coupled to the additional BJT. In some embodiments, the additional pair of MOSFETs may be configured similarly to the other pair of MOSFETs. A feedback loop may maintain the same drain voltage for one of the MOSFETs in each pair. Both MOSFET pairs may include MOSFETs with the same channel width to channel length ratio. For example, one MOSFET in each pair may have one ratio, and another MOSFET in each pair may have another ratio.

The bandgap voltage reference generator may include a resistive circuit element coupled between the source of each MOSFET in the pair of MOSFETs. The bandgap voltage reference generator may sum the current through the resistive circuit element with a current that is proportional to absolute temperature to reduce the effect of the non-linearity of the output voltage. In one embodiment, the resistive circuit element may be a resistor of the same type as an additional resistor through which the current that is proportional to absolute temperature flows. The output voltage may not depend on the magnitude of the current through the resistive circuit element.

A method for operating a bandgap voltage reference generator may involve: powering the bandgap voltage reference generator, where the bandgap voltage reference generator comprises a BJT and a pair of MOSFETs coupled to the BJT; and the bandgap voltage reference generator generating a reference voltage in response to being powered. In response to the bandgap voltage reference generator being powered, the base-emitter voltage Vbe of the BJT exhibits a non-linearity with respect to temperature and a difference between gate-source voltages of the pair of MOSFETs exhibits an opposite non-linearity with respect to temperature. The opposite non-linearity reduces an effect of the non-linearity on the reference voltage.

BRIEF DESCRIPTION OF THE DRAWINGS

The foregoing, as well as other objects, features, and advantages of this invention may be more completely understood by reference to the following detailed description when read together with the accompanying drawings in which.

Figure 1:
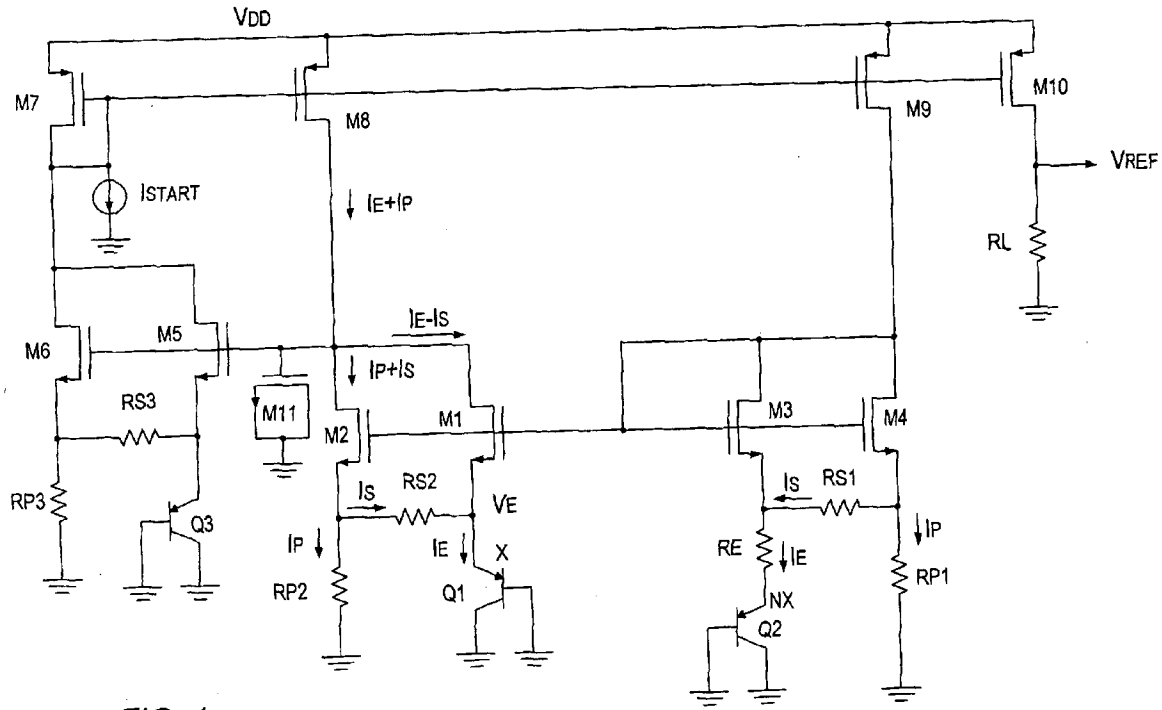
FIG. 1 illustrates a bandgap voltage reference circuit that implements delta Vgs curvature correction, according to one embodiment.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims. Note, the headings are for organizational purposes only and are not meant to be used to limit or interpret the description or claims.

DETAILED DESCRIPTION OF EMBODIMENTS

FIG. 1 illustrates an exemplary bandgap voltage reference circuit that employs delta Vgs curvature correction, according to one embodiment. Note that other embodiments may include different types and/or numbers of components and/or be implemented using different interconnections between components.

The bandgap voltage reference circuit of FIG. 1 includes a startup circuit ISTART that sinks current to ground, several MOSFETs (Metal Oxide Semiconductor Field Effect Transistors) M1–M11, several BJTs (Bipolar Junction Transistors) Q1–Q3, and several resistors RL, RS1–RS3, RP1–RP3, and RE. Several currents IE, IS, IP, IE+IP, IE−IS, and IP+IS are labeled in FIG. 1. Several voltages VREF, VE, and VDD are also labeled. VDD is the supply voltage that powers the bandgap voltage reference circuit. Note that specific types of components shown in FIG. 1 (e.g., resistors) may be replaced with appropriate other types of components (e.g., other resistive circuit elements) in other embodiments.

In this embodiment, resistors with the same alphabetical identifier may have substantially the same value (within tolerances of the type of resistor used to implement each resistor). For example, resistors RS1–RS3 may each have substantially equal resistance. Similarly, resistors RP1–RP3 may have substantially equal resistances.

The bandgap voltage reference circuit includes two BJTs Q1 and Q2 that have a ratio N of emitter current densities. Here, the emitter area NX of Q2 is N times the emitter area X of Q1. Ten is a typical value of N. The difference in emitter current densities is used to induce a voltage proportional to the difference in Vbe of the two BJTs across resistor RE. The delta Vbe between Q1 and Q2 is Vt ln [(IC1/X)/(IC2/NX)], where IC1 is the collector current through Q1 and IC2 is the collector current through Q2. Since, as will be explained below, the same current IE flows through each BJT, IC1=IC2. Accordingly, the delta Vbe equals Vt ln (NLX/X)=Vt ln (N), where Vt=kT/q (T is absolute temperature in degrees Kelvin).

Sx is the ratio of the transistor channel width to the transistor channel length of transistor Mx. Thus, S10 is the ratio of the transistor channel width to the transistor channel length of M10 and S8 is the ratio of the transistor channel width to the transistor channel length of M8. The gate voltages at M8 and M10 are equal, and thus the drain current through M10 is proportional to the drain current through M8, which is IE+IP. Scaling the drain current through M8 by a ratio of S10 to S8 provides the drain current through M10. The output voltage VREF=(S10/S8)(IE+IP)RL. Through application of delta Vgs curvature correction, as described below, the temperature stability of VREF may be improved.

The gates of M3, M4, M2, and M1 are tied together so that these transistors have equal gate voltages. Additionally, values of RS and RP may be selected so that the currents (labeled IE–IS) through M1 and M3 are equal and so that the currents (labeled IP+IS) through M2 and M4 are equal.

The circuit of FIG. 1 uses a feedback loop that includes M5, M6, RS, RP, and Q3. These feedback components may not directly affect the accuracy of VREF at the output of the bandgap voltage reference circuit. However, by keeping the drain voltage of M1 equal to that of M3 and the drain voltage of M2 equal to that of M4, these feedback components operate to keep the drain current through M1 equal to that through M3, and the drain current through M2 equal to that through M4. The feedback loop may also operate to reduce the variation in VREF due to variations in the supply voltage VDD.

Since the drain current through M1 equals that of M3 and the drain current of M2 equals that of M4, and because the gate voltages of M1–M4 equal each other, IE=deltaVbe/RE=VtlnN/RE. IE is proportional to absolute temperature (PTAT). IE varies positively with temperature and acts to remove most of the effects of the temperature dependence of IP, which varies negatively with temperature. The current IP=[VE+(Vgs1–Vgs2)]/RP.

The base-emitter voltage Vbe of a BJT such as Q1 may exhibit a non-linearity with respect to temperature. A pair of MOSFETs such as M1 and M2 may be configured so that the difference between gate-source voltages of the pair of MOSFETs exhibits an opposite non-linearity with respect to temperature. A delta Vgs over R current is added to the delta Vbe over R current flowing in Q1 to linearize the Vbe variation with temperature. This in turn may reduce the effect of the non-linearity on the output voltage VREF of the bandgap voltage reference generator. The difference in gate-source voltages of the pair of MOSFETS may be determined by the ratio of channel width to channel length for each MOSFET included in the pair of MOSFETS.

The current IS=(Vgs1–Vgs2)/RS=sqrt[2(IE–IS)/(S1$\mu$Cox)]–sqrt[2(IP+IS)/(S2$\mu$Cox)], where $\mu$=NMOS electron mobility and Cox is the gate oxide capacitance per unit area. The electron mobility $\mu$ varies inversely with temperature: $\mu$(T)=$\mu$(300)/[(T/300)^a], where T is absolute temperature in degrees Kelvin and a is a value (typically) between 1.0 and 1.5). The temperature coefficient of the electron mobility term $\mu$ in Vgs1–Vgs2 (delta Vgs) corrects for remaining curvature in the IE+IP combination. The temperature variation due to the electron mobility term is scaled according to the values of S1, S2, RS, RP, and RE in order to achieve a desired correction. Note that the magnitude of IS may not affect the sum IE+IP.

To provide a desired curvature correction, the size of transistors M1 and M2 (and of corresponding transistors M3 and M4) may be adjusted until a desired S1/S2 ratio is achieved. Corresponding MOSFETs included in each pair (e.g., M1 may correspond to M3 and/or to M5, and M2 may correspond to M4 and/or to M6) may have the same channel width to channel length ratio. Similarly, the ratio of RS to RP and RE may be adjusted until a desired relationship is obtained. These ratios may be adjusted based on the nominal vertical PNP base carrier mobility and collector current temperature coefficient, which determine the temperature coefficient non-linearity of VE. For a given circuit configuration and reference voltage VREF, the ratios may be adjusted iteratively until a desired curvature correction is achieved. For example, the desired curvature correction may be obtained by simulating a bandgap voltage reference circuit and adjusting the channel widths and/or lengths of different ones of the transistors M1–M4 in the simulated circuit until desired correction is obtained.

In some embodiments, a bandgap voltage reference circuit with delta Vgs curvature correction may be designed by initially setting all MOSFETs to have the same channel width to channel length ratios and then selecting values of all the other components (e.g., N, RS, RP, and RE) to provide a desired VREF at a particular temperature (e.g., room temperature). This selection may be made based on the following equation: VREF=(S10/S8)(IP+IE)RL=(S10/S8){[VE+(Vgs1–Vgs2)]/RP+VtlnN/RE}RL. This circuit may then be simulated or tested to determine the temperature curvature of VREF over a range of temperatures. The channel width to channel length ratios of one or more MOSFETs may then be adjusted (e.g., by adjusting the channel widths of the MOSFET(s) M1–M6) within the simulation or test circuit and re-simulating or re-testing the circuit to observe the new temperature curvature. The channel ratios of the MOSFETs may be iteratively adjusted until a desired curvature correction is achieved.

In the circuit of FIG. 1, no additional active devices are needed to perform curvature correction (however, other embodiments may include additional active devices). Additionally, the ratio S of a MOSFET may be adjusted using any process, and process variations may not have a significant effect on the accuracy of the curvature correction. This may eliminate or reduce the need to perform additional curvature correction tuning after fabrication of the bandgap voltage reference circuit. The added resistors RS are of the same type as RE and RP and are small in value and size. Since the curvature correction depends on Vgs differences and resistor ratios, the curvature correction may not be sensitive to MOSFET threshold voltage or resistor sheet rho variations.

Figure 2:
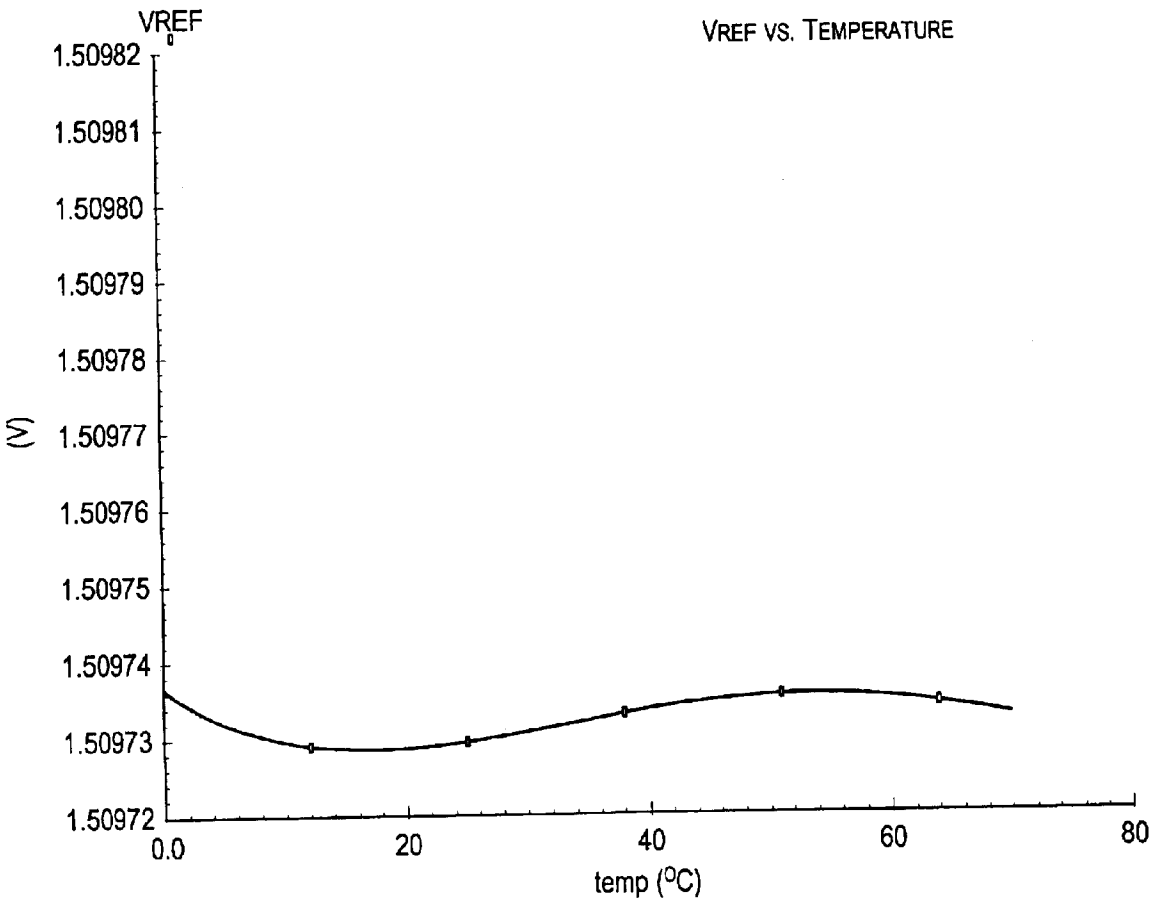
FIG. 2 shows a plot of reference voltage versus temperature generated by a simulation of one embodiment of a circuit that employs delta Vgs curvature correction.

FIG. 2 shows a plot of reference voltage versus temperature generated by a simulation of one embodiment of a circuit that employs delta Vgs curvature correction when generating a reference voltage VREF. In the example of FIG. 2, there is an 8 $\mu$V peak-to-peak reference voltage variation in VREF from 0 to 70 degrees Celsius.

Numerous variations and modifications will become apparent to those skilled in the art once the above disclosure is fully appreciated. It is intended that the following claims be interpreted to embrace all such variations and modifications.

What is claimed is:

1. A bandgap voltage reference generator, comprising:

a BJT (Bipolar Junction Transistor), wherein a base-emitter voltage Vbe of the BJT exhibits a non-linearity with respect to temperature; and a pair of MOSFETs (Metal Oxide Semiconductor Field Effect Transistors) coupled to the BJT, wherein a difference between gate-source voltages of the pair of MOSFETs exhibits an opposite non-linearity with respect to temperature;

wherein the opposite non-linearity reduces an effect of the non-linearity on an output voltage of the bandgap voltage reference generator.

2. The bandgap voltage reference generator of claim 1, further comprising an additional BJT and an additional pair of MOSFETs coupled to the additional BJT.

3. The bandgap voltage reference generator of claim 2, further comprising a feedback loop configured to maintain a same drain voltage for a MOSFET included in the pair and for an additional MOSFET included in the additional pair.

4. The bandgap voltage reference generator of claim 2, wherein a first MOSFET in the pair of MOSFETs has a same channel width to channel length ratio as a first MOSFET in the additional pair of MOSFETs, and wherein a second MOSFET in the pair of MOSFETs has a same channel width to channel length ratio as a second MOSFET in the additional pair of MOSFETs.

5. The bandgap voltage reference generator of claim 1, further comprising a resistive circuit element coupled between a source of each MOSFET in the pair of MOSFETs, wherein the bandgap voltage reference generator is configured to sum a current through the resistive circuit element with a current that is proportional to absolute temperature to reduce the effect of the nonlinearity of the output voltage.

6. The bandgap voltage reference generator of claim 5, wherein the resistive circuit element is a resistor, and wherein the resistor is a same type of resistor as an additional resistor through which a current that is proportional to absolute temperature flows, wherein the output voltage depends on a magnitude of the current that is proportional to absolute temperature.

7. The bandgap voltage reference generator of claim 5, wherein the output voltage does not depend on a magnitude of the current through the resistive circuit element.

8. The bandgap voltage reference generator of claim 1, wherein the difference in gate-source voltages of the pair of MOSFETs is determined by a ratio of channel width to channel length of each MOSFET included in the pair of MOSFETs.

9. A method for operating a bandgap voltage reference generator, comprising:

powering the bandgap voltage reference generator, wherein the bandgap voltage reference generator comprises a BJT (Bipolar Junction Transistor) and a pair of MOSFETs (Metal Oxide Semiconductor Field Effect Transistors) coupled to the BJT, wherein in response to said powering:

a base-emitter voltage Vbe of the BJT exhibits a non-linearity with respect to temperature; and a difference between gate-source voltages of the pair of MOSFETs exhibits an opposite non-linearity with respect to temperature; and the bandgap voltage reference generator generating a reference voltage in response to said powering, wherein the opposite non-linearity reduces an effect of the non-linearity on the reference voltage.

10. The method of claim 9, further comprising a feedback loop maintaining a same drain voltage for a MOSFET included in the pair and for an additional MOSFET included in an additional pair of MOSFETs coupled to an additional BJT.

11. The method of claim 10, wherein a first MOSFET in the pair of MOSFETs has a same channel width to channel length ratio as a first MOSFET in the additional pair of MOSFETs, and wherein a second MOSFET in the pair of MOSFETs has a same channel width to channel length ratio as a second MOSFET in the additional pair of MOSFETs.

12. The method of claim 9, further comprising summing a current through a resistive circuit element with a current that is proportional to absolute temperature to reduce the effect of the non-linearity of the reference voltage, wherein the resistive circuit element is coupled between a source of each MOSFET in the pair of MOSFETs.

13. The method of claim 12, wherein the resistive circuit element is a resistor, and wherein the resistor is a same type of resistor as an additional resistor through which a current that is proportional to absolute temperature flows, wherein the reference voltage depends on a magnitude of the current that is proportional to absolute temperature.

14. The method of claim 9, wherein the difference in gate-source voltages of the pair of MOSFETs is determined by a ratio of channel width to channel length of each MOSFET included in the pair of MOSFETs.

15. A method, comprising:

a base-emitter voltage Vbe of a BJT (Bipolar Junction Transistor) exhibiting a non-linearity with respect to temperature; and a difference between gate-source voltages of a pair of MOSFETs (Metal Oxide Semiconductor Field Effect Transistors) coupled to the BJT exhibiting an opposite non-linearity with respect to temperature;

the opposite non-linearity reducing an effect of the non-linearity on an output voltage of a bandgap voltage reference generator, wherein the bandgap voltage reference generator includes the BJT and the pair of MOSFETs.

* * * * *